52-645
10/15/85 OR 4,546,591

United States Patent [19]

Beltz

[11] Patent Number: 4,546,591

[45] Date of Patent: Oct. 15, 1985

[54] TRUSS SYSTEM AND COMPONENTS THEREOF

[76] Inventor: Thomas G. Beltz, R.D. #3, Box 22, Lehighton, Pa. 18235

[21] Appl. No.: 554,690

[22] Filed: Nov. 23, 1983

[51] Int. Cl.[4] ..... E04H 12/18

[52] U.S. Cl. ..... 52/645; 52/693

[58] Field of Search ..... 52/641, 645, 693, 646

[56] References Cited

U.S. PATENT DOCUMENTS

| | | | |
|---|---|---|---|
| 3,353,320 | 11/1967 | Grasis | 52/693 |
| 3,826,057 | 7/1974 | Franklin | 52/693 X |

FOREIGN PATENT DOCUMENTS

| | | | |
|---|---|---|---|
| 165422 | 8/1954 | Australia | 52/645 |
| 470255 | 8/1937 | United Kingdom | 52/645 |
| 519526 | 6/1976 | U.S.S.R. | 52/641 |

*Primary Examiner*—Carl D. Friedman
*Attorney, Agent, or Firm*—George A. Bode

[57] ABSTRACT

A truss system component comprising upper and lower chord members, a plurality of first strut members extending between the chord members for maintaining the chords in vertically spaced apart relation, the upper and lower chord members providing pin connections for pivotally connecting said first strut member to the lower chord at substantially equally spaced points along the chord, and a plurality of second strut members extending between the chord members for maintaining the chords in vertically spaced apart relation, each of the second struts being at its lower end pivotally connected to one of the first strut members at each of the first points along the lower chord and at its upper end being pivotally connected to the upper chord member at substantially equally spaced second points therealong.

19 Claims, 13 Drawing Figures

TRUSS SYSTEM AND COMPONENTS THEREOF

BACKGROUND OF THE INVENTION

1. Field of the Invention

The present invention relates to a truss system. And more particularly, the present invention relates to a foldable and collapsible truss system which can be assembled at the construction situs and, after use, be collapsed and folded and moved conveniently, in component sections, from such situs.

2. General Background

Various truss systems are known for use in building construction. The building of trusses on a building site is an expensive and time consuming operation. Because of this, the building industry has adopted prefabricated trusses which eliminate costly on-site labor time. When prefabricated trusses are completely assembled, they are shipped to the job site for use but, due to their size, often require an inordinate amount of shipping carriers and thus time and expense. Furthermore, because prefabricated trusses must be ordered to size for each individual structure, the transportation reliability factor is greatly reduced.

Several attempts have been made in the prior art to develop a truss system which is collapsible, foldable and easily transportable in quantity in the collapsed state and, upon arrival at the construction site, adapted to be erected in a short period of time.

U.S. Pat. No. 3,760,550, issued to W. E. Mueller, et al., discloses a truss structure prefabricated and capable of being shipped in a collapsed condition and which can be erected easily at the site into a roof truss while maintaining a desired and predetermined roof pitch.

U.S. Pat. No. 2,642,825, issued to C. A. McElhone, et al., and discloses a foldable and compactable roof truss having a plurality of upper chords hingedly connected at the truss peak, the upper chords being hingedly connected at their truss ends to the truss ends of each of a plurality of bottom chords connected at the center of the truss span. There are further provided compression members and tension members hingedly connected to both the top and bottom chords.

U.S. Pat. No. 2,386,077, issued to C. B. K. Van Norman, also discloses a collapsible roof truss.

U.S. Pat. No. 3,873,573, issued to D. H. Vaughan, and discloses a three-dimensional triangulated truss capable of being retracted to a compact package for storage and shipment and then expanded on site for erection and connection to similar modules.

Other prior art patents exist which show truss systems which are not foldable and collapsible but which attempt to provide adaptability for various construction requirements:

U.S. Pat. No. 3,826,057, issued to J. W. Franklin discloses chords, struts, couplers, connectors and brace components for cooperative interconnection to provide trusses of various lengths, heights and inclinations with fastener elements used at selected positions to provide desired adaptability.

U.S. Pat. No. 3,078,970, issued to R. S. Black, and discloses a truss-type joist longtitudinally adjustable to vary the length thereof by providing overlapping longitudinal sections with bolt holes spaced apart in series for adjustment to elongate or contract the joist according to the span required.

U.S. Pat. No. 3,977,536, issued to S. T. Moore et al., and discloses the conventional "flying" truss deck form.

U.S. Pat. Nos. 4,102,096; 4,102,108; and 4,106,256 all issued to D. L. Cody, and disclose an expandable truss structure and a wide variety of applications of the same.

U.S. Pat. No. 3,966,164, issued to S. S. Dashew, discloses an adjustable truss support.

U.S. Pat. No. 1,376,990, issued to W. F. Zabriskie, discloses a collapsible truss-like structure for reinforced concrete construction.

U.S. Pat. No. 1,458,866, issued to C. H. Wetzel, discloses a collapsible and foldable truss-like structure.

U.S. Pat. No. 3,638,373, issued to G. Chapaman and U.S. Pat. No. 3,605,355, issued to B. J. Solesbee, disclose collapsible roof trusses.

The following U.S. Patents disclose known art pertinent to the field of the invention:

U.S. Pat. No. 3,942,618, issued to J. W. Franklin.

U.S. Pat. No. 1,141,385, issued to J. O. Ellinger.

U.S. Pat. No. 4,237,869, issued to F. H. Rooney.

U.S. Pat. No. 3,564,783, issued to S. B. Dunne.

Further prior art which is known to the applicant but not the subject of a U.S. Patent is an aluminum truss system marketed under the trademark SYMONS. Catalogs illustrating the SYMONS truss system are enclosed as Exhibits A and B.

Many of these truss systems suffer in that they are bulky in the collapsed state and have a complex structure requiring extensive time and effort to re-assemble the truss from its collapsed state. Some of the patented devices require a voluminous amount of pins and fasteners to interconnect component parts which can be lost or misplaced when the assembly is in the collapsed condition. Other devices, when collapsed, may be compact but in only one dimension thus leaving a large width, length or height as the case may be.

Therefore, it is as an object of the present invention to provide a truss system which is collapsible and compactable to a size allowing for ease of shipment in quantity.

It is a further object of the present invention to provide a collapsible and compactable truss system which can be expanded and assembled in a minimum amount of time.

It is a further object of the present invention to provided a collapsible and compactable truss system having a minimum amount of removable fasteners and spacers.

It is a further object of the present invention to provide a collapsible and compactable truss system which maintains its structural integrity and strength in the assembled position.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EMBODIMENT

Figure 2:
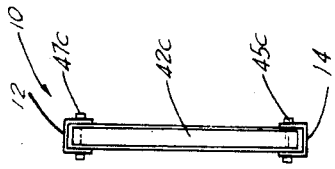
FIG. 2 is an end view of the truss system of FIG. 1.
Figure 1:
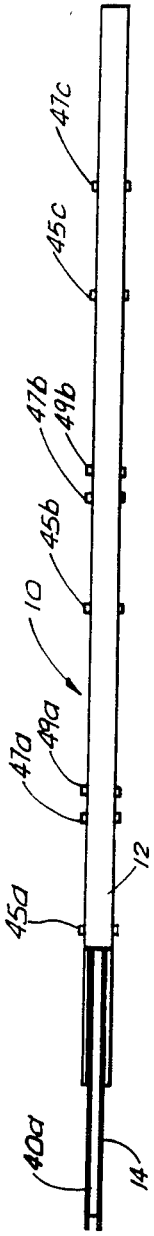
FIG. 1 is a side elevational view of the truss system of the preferred embodiment of the present invention when fully erected.
Figure 5:
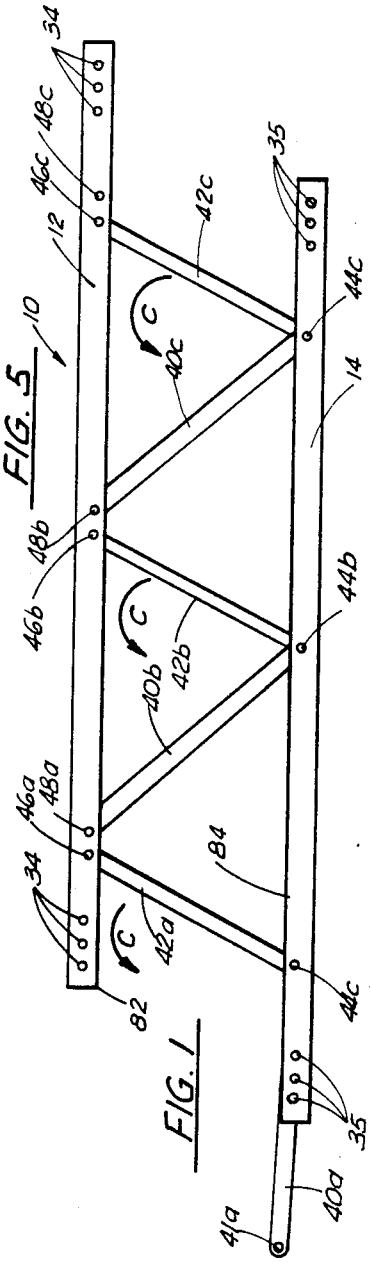
FIG. 5 is a top view of the truss system of FIG. 1.
Figure 3:
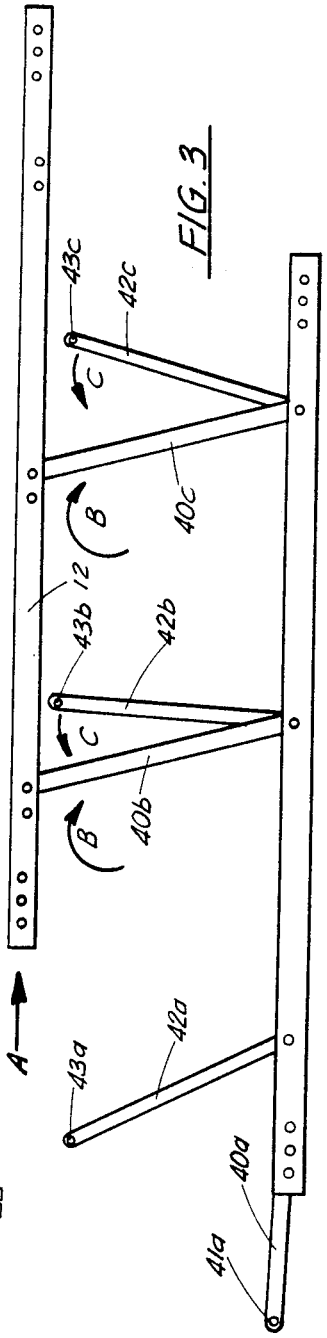
FIG. 3 is a side elevational view of the truss system of FIG. 1 illustrating the first stage of collapse.
Figure 4:
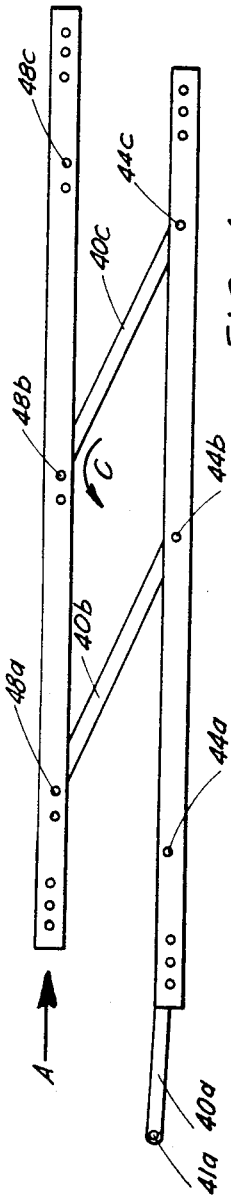
FIG. 4 is a side elevational view of the truss system of FIG. 1 in a partially collapsed condition.

FIGS. 1, 2 and 5 best show the apparatus 10 of the present invention in the assembled condition. In the assembled condition, truss section 10 is comprised of upper and lower chord members 12, 14 which are made of U-shaped channels 20, 30 having flanged or side walls and top or bottom portions. U-shaped channel 20 of upper chord 12 is provided with flanges or side walls 16, 18 integral with top portion 17. Similarly, lower chord 14 is made of U-shaped channel 30 having flanges or side walls 22, 24 integrally joined with bottom portion 23. Thus truss 10 component whether in the assembled, partially collapsed or collapsed position provides upper and lower chords 12, 14 in vertically spaced substantially parallel relation to each other such that channels 20 and 30 face each other across the vertical spacing. The channels 20, 30 provided in upper and lower chords 12, 14 are adapted to receive and snuggly engage the exterior sides of struts 40, all of which are of identical length. Struts 40 have holes 41, best seen in FIG. 9, (and seen in phantom view in FIG. 8) drilled transversely therethrough in a position a slight distance away from the curved ends of the struts. With this structure, the struts 40 may be received in channels 20 and 30, and their holes 41 may be brought into alignment with holes 44 and 48, which are drilled transversely through both side walls (16, 18 and 22, 24) of upper and lower chords 14, 16. A plurality of pins 45, 49 are provided for engagement through holes 44, 48 respectively and the aligned end holes 41 of struts 40 to provide the assembly shown in FIGS. 1, 3 and 4. All of the holes 44, 48 are of a precise diameter adapted to receive and snugly engage pins 45, 49, which are not of a standard size. The diameter of holes 41, 44, and 48 should preferably be just slightly smaller than the diameter of pins 45, 49 to provide a snug fit. With this type of snug fit, the pins 45, 49 must be driven into and out of engagement but securely support truss 10 when assembled.

Figure 7:
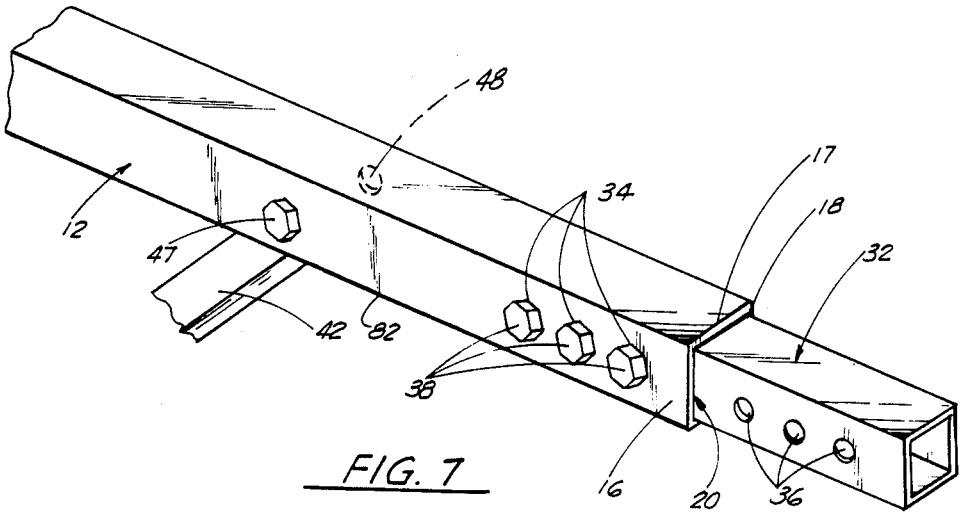
FIG. 7 is a partial perspective view illustrating the upper chord and a chord coupler.

At both ends of chord members 12, 14 a plurality of holes 34, 35 respectively are provided for use when a similar truss section is to be joined to truss section 10. As best seen in FIG. 7, for joining chord sections together a chord coupler 32 is provided. Chord coupler 32 may be of a U-shaped channel construction (similar to chords 12, 14) or rectangular construction as long as it is dimensioned to snugly fit within the confines of channels 20 and 30. It is to be understood that the description and illustration of the use of chord coupler 32 is for upper chord 12, however, it is to be similarly employed with lower chord section 14. For the illustrative case of upper chord 12 as shown in FIG. 7, the end holes 34 in chord 12 are spaced and patterned to correspond precisely to the spacing and pattern of end holes 36 of chord coupler 32 and, as stated hereinabove, chord coupler 32 is of a size for close interfitting telescopically within chord 12 so that when holes 34 are brought into alignment with coupler holes 36, pins 38, which are identical to pins 45, 49, are engaged through these holes to hold a pair of chord sections 12 in alignment for transmitting arrangement. The use of such couplers 32 allows sections of upper chord 12 and lower chord 14 to be joined each to the other to provide a composite assembled truss. If the composite truss is to be divided into separate truss components again, the pins 38 will be removed, the chord sections 12, 14 separated and chord couplers 32 removed. Conversely, when any two separate previously assembled truss components are to be interconnected in end to end relation to provide a longer composite truss, two chord couplers 32 for one end, and additional pins 38 will be required to maintain the assembly. In this way the ends of an assembled composite truss will always maintain holes 34, 35 for further extension of the truss so they may be used for attaching the truss to a fastener system as required. The holes 34, 35 by virture of their position in chords 12, 14 do not affect the collapsibility nor compactibility of the truss.

Figure 8:
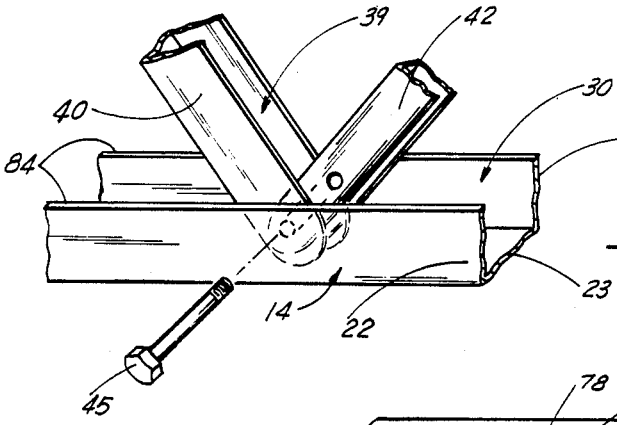
FIG. 8 is a partial perspective view of the assembly of the lower chord and struts.
Figure 9:
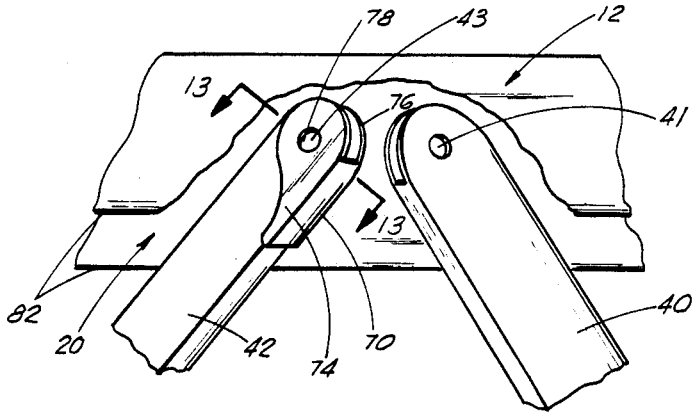
FIG. 9 is a partial cutaway view of the assembly of the upper chord and struts and spacer.
Figure 13:
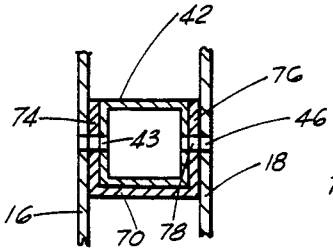
FIG. 13 is a sectional view taken along line 13—13 of FIG. 9.
Figure 12:
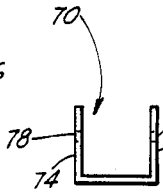
FIG. 12 is an end view of the spacer of FIG. 9.
Figure 11:
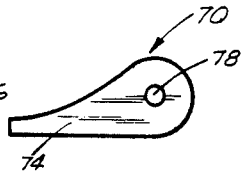
FIG. 11 is a side elevational view of the spacer of FIG. 9.
Figure 10:
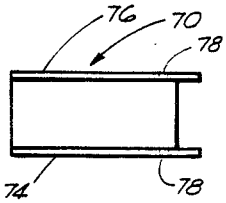
FIG. 10 is a top view of the spacer of FIG. 9.

Channels 20, 30 of upper and lower chords 12, 14 respectively are further adapted to receive struts 42. Struts 42 are all of identical dimension but dimensioned differently than struts 40. As best seen in FIG. 8, struts 40 are dimensioned so that their exterior side walls snugly engage the interior side walls of channels 20, 30. Further, struts 40 are themselves dimensioned to form a U-shaped channel in much the same manner as chords 12, 14. Struts 40 further are provided to maintain the predetermined vertical spacing of chords 12, 14 as holes 44, 48 are substantially equally spaced along their respective chords 14, 12, although holes 44 and 48 are offset relative to each other in the assembled condition of FIG. 1. Unlike struts 40, struts 42 are not adapted to snugly engage the interior sides of channels 20, 30 respectively, but contrarily dimensioned not to do so, but to be received into the confines of channels 39 of struts 40. Further, struts 42 will be of a length less than the length of struts 40 and will be dimensioned according to the vertical spacing between chords 12 and 14 and the spacing between holes 46 and 48 to be discussed further herein.

Struts 42 may be provided in either rectangular form, U-shaped channel form or tubular form as may be required as long as it is dimensioned to be received in channel 39 of strut 40. Whatever the shape of struts 42, they are to be provided with holes 43 drilled transversely through them in position a slight distance away from either end of the struts. With this arrangement, the struts 42 may be received in channels 20, 30 and holes 43 may be brought into alignment with holes 46 in upper chord 12 and holes 41 in struts 40 and holes 44 in lower chord 14 to provide the assembled condition of FIGS. 1, 2, and 5. All of the holes 41, 43, 44, 46 are, as referenced above, of such a diameter to receive and snugly engage pins 45 and 47 which are provided in chords 14, 12 respectively.

Figure 6:
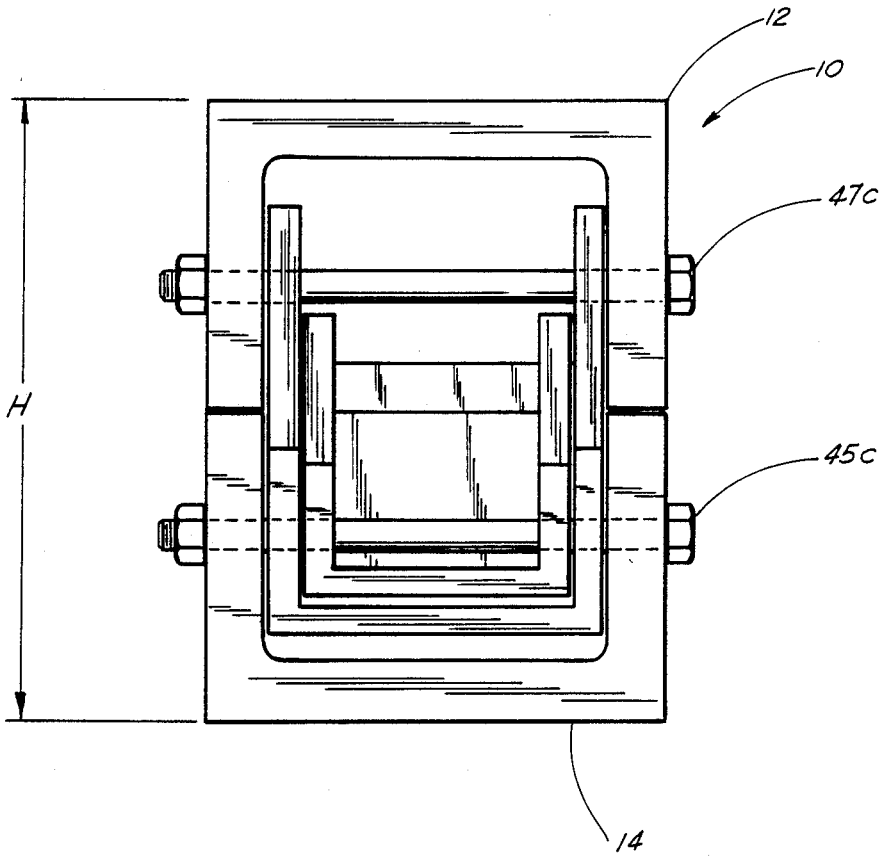
FIG. 6 is an end view of the truss system of FIG. 1 in the fully collapsed position.

In order for the struts 40, 42 to be collapsed completely to the position of FIG. 6, the lengths of struts 40 and 42, and the spacing of holes 44 of lower chord 14 and holes 46, 48 of upper chord 12 must be precisely calculated. This can be done by first determining the required vertical spacing of chords 12, 14 which controls the hole spacing of holes 44 on lower chord 14. Therefore, it follows that upper chord 12 must also be provided with holes 46 and 48 which must have the same relative spacing as holes 44. The vertical spacing of the chords 12, 14 thus controls the length and the maximum spacing of the holes 44, 46 and 48. Once this is determined, the length of struts 40 can be determined and in turn the length of struts 42, which are less than that of struts 40. Thus it can be seen that in the assembled condition of FIG. 1, struts 40 control the vertical spacing of chords 12, 14 and thus the height of the truss by providing a series of diagnonal support members pivotally connected to chords 12 and 14 in holes 48, 44 respectively, and that any particular diagonal strut 40 is pivotally fastened to upper chord 12 at a hole 48 disposed laterally and to the left, as seen in FIG. 1, of hole 44. Thus, as illustrated in FIG. 1, with the truss in the assembled condition, strut **40*b* is pivotally connected at either end to chords 12, 14 at holes 48*a*, 44*b* respectively by pins 49*a*, 45*b* respectively. As seen in FIG. 1, any pairs of struts 40, 42 will be provided such that strut 42, which is of a lesser length than strut 40, will be disposed laterally to the right or rotated clockwise of strut 40 at an angle normally less than 90° and both struts 40, 42 integrally pivotally hinged to lower chord 14 by having hole 43 provided in the lower end of strut 42 brought into alignment with hole 41 in the lower end of strut 40 and hole 44 of chord 14 with pin 45 provided therethrough to complete the engagement. With this arrangement, to complete the assembly of truss 10, struts 42 will be pivotally connected to upper chord 12 by having holes 43 near its upper ends brought into alignment with holes 46 and pins 47 provided for engagement through the alligned holes. Thus struts 42 will be diagonally disposed so that their ends are pivotally pinned to holes 44, 46 in chords 14, 12 respectively, such holes 44, 46 being laterally offset from each other, the hole 46 in upper chord 12 being disposed to the right of the hole 44 in lower chord 14 for any given strut 42, as viewed in FIG. 1**.

Thus strut **42*a* will be pivoted at either end through holes 44*a*, 46*a*; strut 42*b* through holes 44*b*, 46*b*, and so on. (While struts 40 and 42 will normally be disposed relative to each other at an angle less than 90° when truss 10** is in the assembled condition, if there was a special need for a very short truss, then the angle could be greater than 90°.)

The structuring of the assembled truss 10 as illustrated in FIG. 1, will provide for pin 47 which is to be snugly engaged in aligned holes 43, 46, yet be easily removed when it is desired to collapse truss 10. To provide for easy collapse and compaction of truss 10 and to prevent the misplacing or loss of pins, fasteners 45 and 49 can be more permanently secured in respective chords 12, 14 by providing for fasteners such as nut and bolt combinations, welded portions and the like.

Returning now to FIG. 1 and the method of collapsing and compacting truss 10, it is to be understood that only pins 47 provided through aligned holes 43, 46 and spacers 70, if used, need be removed. Spacers 70 provide protection to chord 12 if nuts and bolts are used as the fastening means instead of pins 47. Without spacers 70, the use of nuts and bolts through holes 46 and 43 would draw side walls 16, 18 into channel 20 thus collapsing chord 12. Spacers 70 in the preferred embodiment would be dimensioned to space its walls apart the same width as that of strut 40 so that exterior side walls 74, 76 of spacer 70 snugly engage the interior walls of channel 20 of chord 12. With the removal of pins 47 (and spacers 70, if used) from upper chord 12, upper chord 12 is moved laterally or horizontally in the direction of ARROW A or to the right in FIG. 2, a distance sufficient to bring the upper end of struts 42 out of engagement with the interior surface of top portion 17 of channel 20. This movement of upper chord 12 in the direction of ARROW A will increase the vertical spacing between chords 12 and 14 and rotate struts 40 clockwise in the direction of ARROW B, thus assuming the position of truss 10 in FIG. 3. From this position, struts 42 will be rotated counterclockwise opposite the direction of ARROW B (or in the direction of ARROW C) and be received into channels 39 of corresponding or mating struts 40 due to the relative dimensions of struts 40 and 42 as discussed above. With struts 42 confined to channels 39 of corresponding struts 40, they can no longer engage the interior surface of top portion 17 of channel 20 when upper chord 12 is moved in the direction opposite ARROW A to the original vertical spacing between chords 12, 14 illustrated in FIG. 1. Then chord 12 can be moved even further in the direction opposite ARROW A to diminish the spacing between chords 12 and 14 and approach the partially collapsed position of FIG. 4. This movement of chord 12 in the direction opposite ARROW A with struts 42 maintained in corresponding struts 40 will cause the movement of struts 40 and 42 in a direction opposite ARROW B to the position of FIG. 4. It can therefore be seen that from the position of FIG. 4, it is a simple matter to move upper chord 12 in the direction opposite ARROW A and thus cause the total collapse of truss 10 to the position of FIG. 6 with upper and lower chords 12, 14 in abutment with each other at their marginal edges 82, 84 and struts 40 maintained in the confines of channels 20 and 30 which are now mated to provide the height H illustrated in FIG. 6. Thus truss 10 is totally collapsed and compacted, a feature not obtainable in the prior art discussed hereinabove.

Once the truss has been collapsed to the position of FIG. 6, it can be expanded and re-assembled to the position of FIG. 1 by merely reversing the above-described method. First, chords 12, 14 will be vertically separated by imparting lateral motion to upper chord 12 in the direction of ARROW A thus causing the rotation of struts 40 and 42 (provided in channel 39 of struts 40) in the direction of ARROW B until chords 12 and 14 are separated a vertical distance such that struts 42 can be rotated further in the direction of ARROW B without contacting the inner surface of top portion 17 of channel 20. At this point, upper chord 12 is moved in the direction opposite ARROW A so that companion struts **40*b*, 42*b*'s relative angle is increased to that illustrated in FIG. 1, at which point holes 43 and of struts 42 are brought into alignment with holes 46 and upper chord 12 so that removable pins 47 (or other fasteners) can be placed therethrough to secure truss 10 in the assembled position of FIG. 1. With nuts and bolts spacers 70 will be used with holes 78 aligned with holes 43 and 46** as provided above.

Of course, many sections of truss 10 can be placed end to end and fixedly connected by means of holes 34 and 35 and couplers 32 to provide a truss of a length adapted to any building specifications. In practice, the sections will be made up at a specific job site and the trusses may be moved at the job site from one pour location to the next as needed.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A truss system component comprising:

a. upper and lower chord members;

b. a plurality of first strut members fixedly and pivotally attached to and extending between said chord members for maintaining said chord members in substantially vertically spaced apart relationship, said upper and lower chord members providing means for pivotally connecting said first strut members thereto at substantially equally spaced first points along said upper chord member and substantially equally spaced second points along said lower chord member; and c. a plurality of second strut members pivotally attached to and extending between said chord members for maintaining said chord members in substantially vertically spaced apart relationship, each of said second strut members being at its lower end fixedly and pivotally connected to one of said first strut members at each of said second points along said lower chord member and at its other other end being removably and pivotally connected to said upper chord member at substantially equally spaced third points therealong, each of said third points being substantially equally spaced from its adjacent first point.

2. The apparatus of claim 1, further comprising means interconnecting said chord members and strut members for the transmission of forces to be carried by said truss component and for holding said chord members and strut members in an operative assembled relation wherein said first and third point positions along said top chord member are longitudinally offset with respect to said second point positions along said bottom chord member.

3. The apparatus of claim 1 further comprising a plurality of chord coupler elements interconnected to and joining the ends of successive top and bottom chord members for providing a truss system for the transmission of loading between truss components.

4. The apparatus of claim 1 wherein said second strut members are of a length less than said first strut members.

5. The apparatus of claim 1, wherein said upper and lower chord members are substantially U-shaped thus providing channel portions therealong.

6. The apparatus of claim 5, wherein said channel portions of said upper and lower chord members are adapted to receive said first strut members therein.

7. The apparatus of claim 6, wherein each of said first strut members is substantially U-shaped thus providing a channel portion therealong.

8. The apparatus of claim 7, wherein said channel portions of said first strut members are adapted to receive said second strut members therein.

9. The apparatus of claim 1, wherein said upper and lower chord members and said first strut members are substantially U-shaped thus providing in each a channel portion therealong and wherein said channel portions of said upper and lower chord members are adapted to receive upon rotational movement of said first strut members said first strut members therein and said first strut members are adapted to receive upon rotational movement of said second strut members said second strut members therein.

10. A truss system component comprising:

a. upper and lower chord members;

b. a plurality of first strut members fixedly and pivotally attached to and extending diagonally between said chord members for maintaining said chord members in substantially vertically spaced apart relationship, said upper and lower chord members providing means for pivotally connecting said first strut members thereto at substantially equally spaced first points along said upper chord member and substantially equally spaced second points along said lower chord member;

c. a plurality of second strut members pivotally attached to and extending between said chord members for maintaining said chord members in substantially vertically spaced apart relationship, each of said second strut members being at its lower end fixedly and pivotally connected to one of said first strut members at each of said second points along said lower chord member and at its other end being removably and pivotally connected to said upper chord member at substantially equally spaced third points therealong, each of said third points being substantially equally spaced from its adjacent first point; and d. means interconnecting said chord members and strut members for the transmission of forces to be carried by said truss component and for holding said chord members and strut members in an operative assembled relation wherein said first and third point positions along said top chord member are longitudinally offset with respect to said second point positions along said bottom chord member.

11. The apparatus of claim 10 further comprising a plurality of chord coupler elements interconnected to and joining the ends of successive top and bottom chord members for providing a separate truss system for the transmission of loading between truss components.

12. The apparatus of claim 10 wherein second strut members are of a length less than said first strut members.

13. The apparatus of claim 10, wherein said upper and lower chord members are substantially U-shaped thus providing channel protions therealong.

14. The apparatus of claim 13, wherein said channel portions of said upper and lower chord members are adapted to receive said first strut members therein.

15. The apparatus of claim 14, wherein each of said first strut members is substantially U-shaped thus providing a channel portion therealong.

16. The apparatus of claim 15, wherein said channel portions of said first strut members are adapted to receive said second strut members therein.

17. The apparatus of claim 10, wherein said upper and lower chord members and said first strut members are substantially U-shaped thus providing in each a channel portion therealong and wherein said channel portions of said upper and lower chord members are adapted to receive upon rotational movement of said first strut members said first strut members therein and said first strut members are adapted to receive upon rotational movement of said second strut members said second strut members therein.

18. A truss component comprising:

a. upper and lower chord members;

b. a plurality of first strut members fixedly and pivotally attached to and extending substantially diagonally between said chord members for maintaining said chord members in substantially vertically spaced apart relationship, said upper and lower chord members providing means for pivotally connecting said first strut members thereto at substantially equally spaced first points along said upper chord member and substantially equally spaced second points along said lower chord member;

c. a plurality of second strut members, of a length less than said first strut members, pivotally attached to and extending substantially diagonally between said chord members for maintaining said chord members in substantially vertically spaced apart relationship, each of said second strut members being at its lower end fixedly and pivotally connected to one of said first strut members at each of said second points along said lower chord member and at its other end being removably and pivotally connected to said upper chord member at substantially equally spaced third points therealong, each of said third points being substantially equally spaced from its adjacent first point;

d. means interconnecting said chord members and strut members for the transmission of forces to be carried by said truss component and for holding said chord members and strut members in an operative assembled relation wherein said first and third point positions along said top chord member are longitudinally offset with respect to said second point positions along said bottom chord member; and e. a plurality of chord coupler elements interconnected to and joining the ends of successive top and bottom chords for providing a truss system for the transmission of loading between truss components.

19. The apparatus of claim 18, wherein said upper and lower chord members and said first strut members are substantially U-shaped thus providing in each a channel portion therealong and wherein said channel portions of upper and lower chord members are adapted to receive upon rotational movement of said first strut members said first strut members therein and said first strut members are adapted to receive upon rotational movement of said second strut members said second strut members therein.

* * * * *